US010889111B2

(12) United States Patent
Stoeckle et al.

(10) Patent No.: US 10,889,111 B2
(45) Date of Patent: Jan. 12, 2021

(54) METHOD AND PRINTER FOR REDUCING INTENSITY FLUCTUATIONS

(71) Applicant: Océ Holding B.V., Venlo (NL)

(72) Inventors: Ulrich Stoeckle, Munich (DE); Uwe Hofmann, Munich (DE); Hans Gollatz, Herkenbosch (NL); Lars Joergens, Baldham (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/162,834

(22) Filed: Oct. 17, 2018

(65) Prior Publication Data

US 2019/0111675 A1 Apr. 18, 2019

(30) Foreign Application Priority Data

Oct. 17, 2017 (DE) ..... 10 2017 124 112

(51) Int. Cl.

| | |
|---|---|
| ***B41J 2/045*** | (2006.01) |
| ***B41J 2/21*** | (2006.01) |
| ***B41J 2/145*** | (2006.01) |
| ***B41J 2/155*** | (2006.01) |

(52) U.S. Cl.

CPC ..... *B41J 2/04596* (2013.01); *B41J 2/04581* (2013.01); *B41J 2/04588* (2013.01); *B41J 2/04593* (2013.01); *B41J 2/145* (2013.01); *B41J 2/155* (2013.01); *B41J 2/2132* (2013.01); *B41J 2/2146* (2013.01); *B41J 2202/20* (2013.01)

(58) Field of Classification Search

CPC ... B41J 29/38; B41J 2/07; B41J 2/2132; B41J 2/04581; B41J 2/04593; B41J 2/0458; B41J 2202/20; B41J 2/04588; B41J 2/04596; B41J 2/145; B41J 2/155; B41J 2/2146

See application file for complete search history.

(56) References Cited

U.S. PATENT DOCUMENTS

| | | | | |
|---|---|---|---|---|
| 2009/0244135 | A1 | 10/2009 | Kaieda et al. | |
| 2010/0182367 | A1 | 7/2010 | Takagi et al. | |
| 2010/0207982 | A1 | 8/2010 | Satoh et al. | |
| 2015/0070429 | A1* | 3/2015 | Takahashi | B41J 2/04563 347/14 |
| 2018/0029360 | A1 | 2/2018 | Stoeckle | |

FOREIGN PATENT DOCUMENTS

DE 102016113929 A1 2/2018

OTHER PUBLICATIONS

Foreign action—Application No. 10 2017 124 112.4, dated Jun. 20, 2018.

* cited by examiner

*Primary Examiner* — Jannelle M Lebron
(74) *Attorney, Agent, or Firm* — Schiff Hardin LLP

(57) ABSTRACT

An inkjet printer having at least one print head in which at least one edge region nozzle at the edge of the print head is not activated for the printing of a print image, but nevertheless is activated at least temporarily with non-ejection pulses without ink ejection. Intensity fluctuations of the dots of a print image that are printed by the remaining nozzles of the print head may be reduced via the activation of an edge region nozzle with non-ejection pulses.

11 Claims, 3 Drawing Sheets

METHOD AND PRINTER FOR REDUCING INTENSITY FLUCTUATIONS

CROSS REFERENCE TO RELATED APPLICATIONS

This patent application claims priority to German Patent Application No. 102017124112.4, filed Oct. 17, 2017, which is incorporated herein by reference in its entirety.

BACKGROUND

The disclosure relates to a method and a corresponding inkjet printer for reducing fluctuations in the intensity of dots within a print image.

An inkjet printing device typically includes one or more print heads respectively having a plurality of nozzles. Each nozzle configured to fire or push ink droplets onto a recording medium. The different nozzles of a print head may exhibit fluctuations with regard to the intensity and/or the optical density of dots that may be printed with the respective nozzle. DE 10 2016 113 929 A1 describes a method for stabilizing an ink meniscus. US 2009/0244135 A1 describes a method for achieving uniform ejection conditions for the nozzles of a printing device. US 2010/0182367 A1 describes a printing device with overlapping print heads.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 3A:
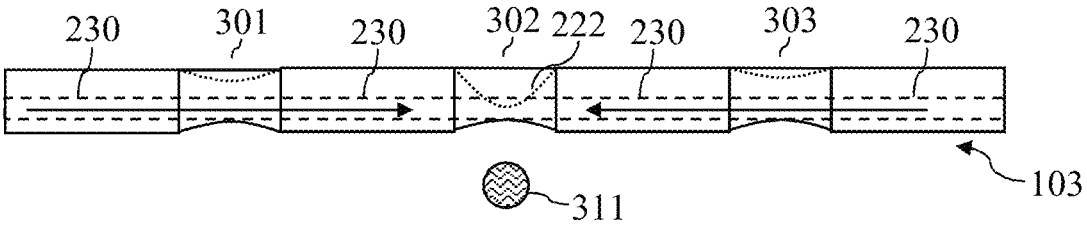
Figure 3B:
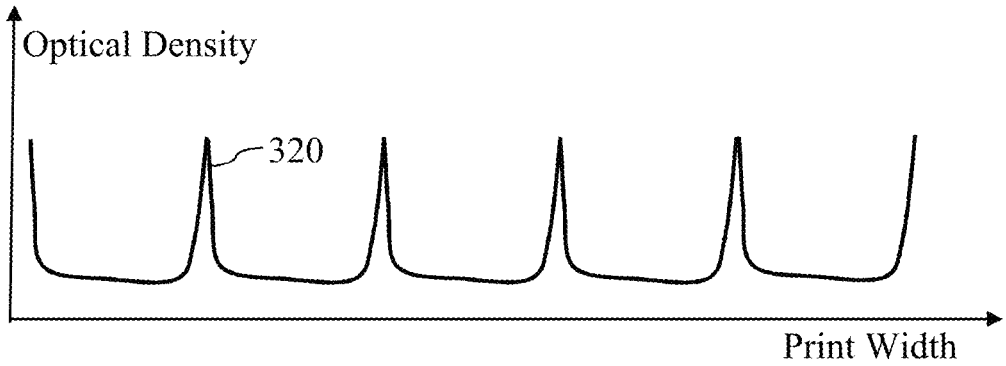
Figure 4A:
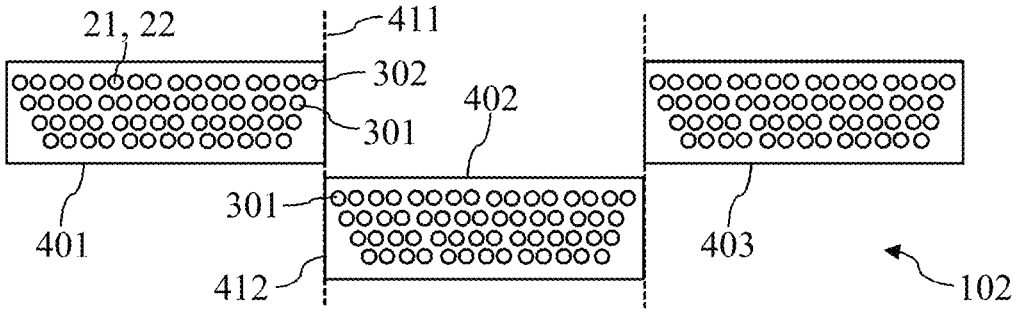
Figure 4B:
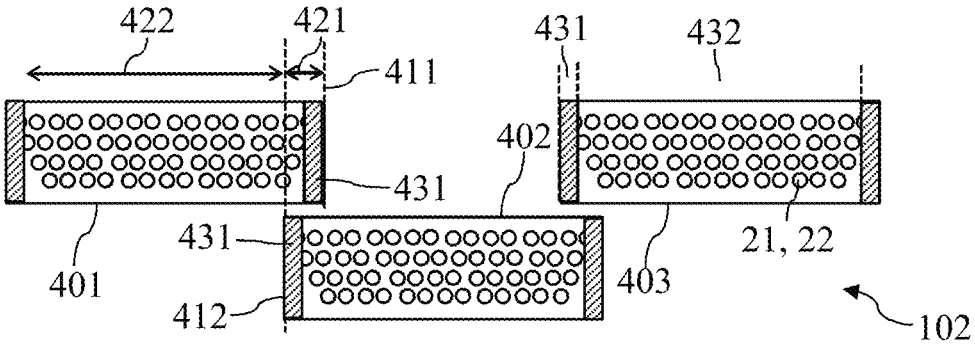
Figure 4C:
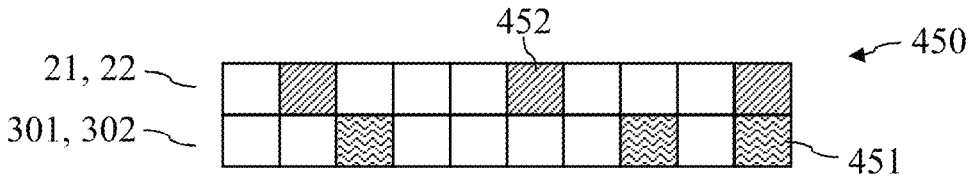
Figure 5:
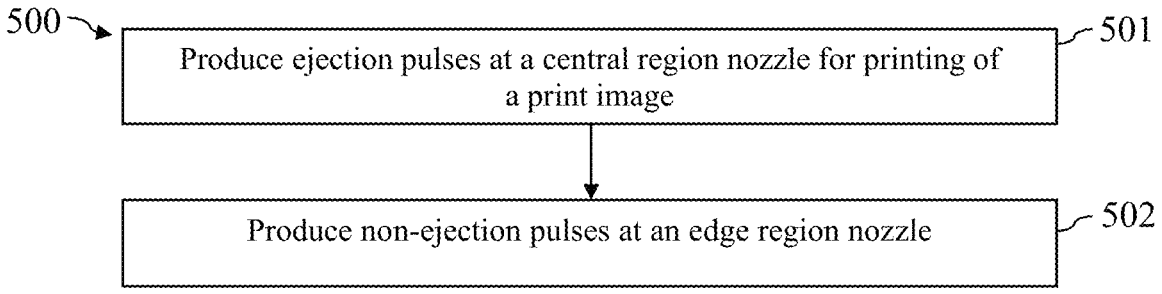

FIG. 3*a* illustrates an example of an activation situation of a row of adjacent nozzles according to an exemplary embodiment of the present disclosure;

FIG. 3*b* illustrates an example of a curve of the optical density of a print image along the print width of a printer according to an exemplary embodiment of the present disclosure;

FIG. 4*a* illustrates an arrangement of print heads in a print bar according to an exemplary embodiment of the present disclosure;

FIG. 4*b* illustrates an overlapping arrangement of print heads according to an exemplary embodiment of the present disclosure;

FIG. 4*c* illustrates activation data for nozzles of a print head according to an exemplary embodiment of the present disclosure; and FIG. 5 illustrates a workflow diagram of a method for printing a print image according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure includes reducing intensity fluctuations of the dots printed with an inkjet printer.

According to one exemplary aspect of the disclosure, an inkjet printing system is described that comprises a first print head. The first print head comprises a central region having a plurality of central region nozzles and an edge region, at least at one edge, having at least one first edge region nozzle. Moreover, the printer comprises a controller that is configured to activate the different central region nozzles depending on print data for respective different columns of a print image in order to print dots of the print image line by line onto the recording medium. The controller is also configured to activate the first edge region nozzle during the printing of the print image, not for the printing of dots in a line of the print image but rather with a non-ejection pulse without ink ejection. Via a non-ejection pulse, it is brought about that ink vibrates in the first edge region nozzle but no ink droplet is thereby ejected.

According to a further aspect of the disclosure, an inkjet printer is described that comprises at least one print bar having a first print head and a second print head. The first print head and the second print head overlap in an overlap region such that dots of a common column of a print image may be printed with at least one overlap region nozzle of the first print head and a second overlap region nozzle of the second print head. Furthermore, the first print head and the second print head respectively comprise a plurality of non-overlap region nozzles in a respective non-overlap region, with which non-overlap region nozzles respective different columns of a print image may be printed.

In an exemplary embodiment, the controller that is configured to activate the different non-overlap region nozzles, depending on print data for respective different columns of a print image, in order to print dots of the print image onto the recording medium. In an exemplary embodiment, the controller is moreover configured to activate a respective actuator of the first overlap region nozzle and/or of the second overlap region nozzle, depending on print data for the common column, such that dots of the print image are printed onto the recording medium by the first overlap region nozzle and/or by the second overlap region nozzle. In an exemplary embodiment, the controller is further configured to have the effect that both the actuator of the first overlap region nozzle and the actuator of the second overlap region nozzle are activated, at least momentarily, during the printing of the print image.

Figure 1:
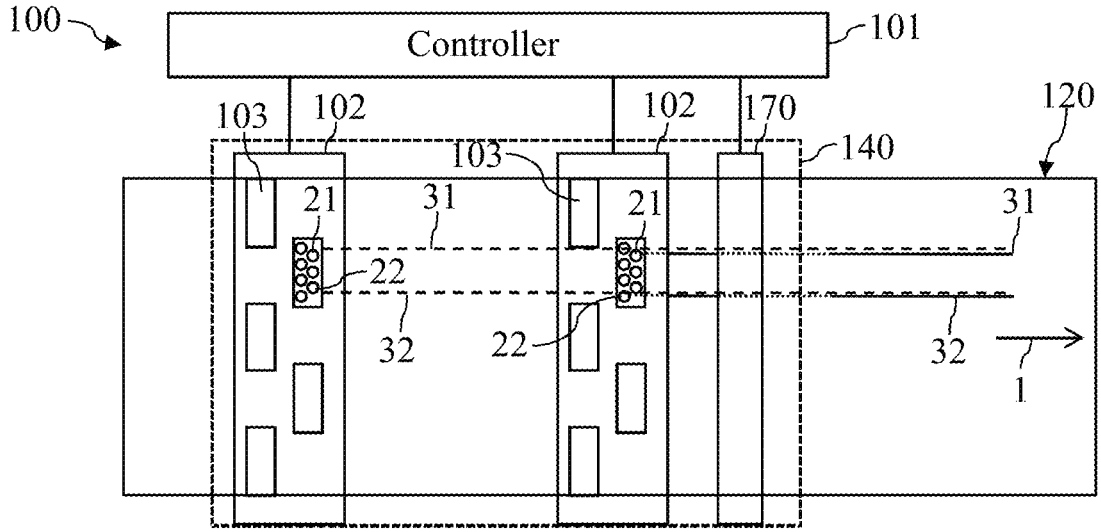
FIG. 1 illustrates a block diagram of an inkjet printer according to an exemplary embodiment of the present disclosure.

FIG. 1 illustrates printer 100 according to an exemplary embodiment. The printer 100 can be configured for printing to a recording medium 120 in the form of a web, (also referred to as a "continuous feed", since the recording medium 120 is supplied continuously to the printer 100, for example from a roll). The recording medium 120 may be produced from paper, paperboard, cardboard, metal, plastic, textiles, a combination thereof, and/or other materials that are suitable and can be printed to. The recording medium 120 is typically taken off a roll (the take-off) and then supplied to the print group 140 of the printing system 100. A print image is applied onto the recording medium 120 by the print group 140, and the printed recording medium 120 is taken up again on an additional roll (the take-up) (possibly after fixing of the print image). Alternatively, the recording medium 120 that is printed to may be cut into sheets or individual pages by a cutting device. In FIG. 1, the transport direction 1 of the recording medium 120 is represented by an arrow. The embodiments in this document are also applicable to a printer 100 for printing to recording media 120 in the form of sheets or pages.

In an exemplary embodiment, the print group 140 of the printing system 100 includes two print bars 102 that may respectively be used for printing with ink of a defined color (for example black, cyan, magenta and/or yellow) and/or special inks. A print group 140 may thus comprise a plurality of print bars 102 for printing with respective different inks. Furthermore, the print group 140 may comprise at least one fixer 170 that is configured to fix a print image printed onto the recording medium 120. A fixer 170 may possibly be arranged after each print bar 102 in order to at least partially fix the print image applied by the respective print bar 102.

In an exemplary embodiment, a print bar 102 includes multiple print heads 103 that are possibly arranged next to one another in multiple rows in order to print the dots of different columns 31, 32 of a print image onto the recording medium 120. In the example depicted in FIG. 1, a print bar 102 comprises five print heads 103, wherein each print head 103 prints the dots of one group or of one block of columns 31, 32 of a print image onto the recording medium 120.

In the embodiment depicted in FIG. 1, each print head 103 of the print group 140 includes multiple nozzles 21, 22, wherein each nozzle 21, 22 is configured to fire or push ink droplets onto the recording medium 120. Depending on print resolution, a print head 103 of the print group 140 may comprise multiple thousands of effectively used nozzles 21, 22 that are arranged along one or more rows transversal to the transport direction 1 of the recording medium 120. The nozzles 21, 22 in the individual rows may be arranged offset from one another. Dots of a line of a print image may be printed onto the recording medium 120, transversal to the transport direction 1 (meaning along the width of the recording medium 120), by means of the nozzles 21, 22 of a print head 103 of the print group 140.

In an exemplary embodiment, the printer 100 includes a controller 101 (for example, an activation hardware, and/or a processor) that is configured to activate the actuators of the individual nozzles 21, 22 of the individual print heads 103 of the print group 140 in order to apply the print image onto the recording medium 120 depending on print data.

In an exemplary embodiment, the print group 140 of the printer 100 includes at least one print bar 102 having K nozzles 21, 22 that may be activated with a specific line clock in order to print a line (transversal to the transport direction 1 of the recording medium 120) with K pixels or K columns 31, 32 onto the recording medium 120. A specific nozzle thus prints a corresponding specific column 31, 32 (in the transport direction 1) onto the recording medium 120 (in a one-to-one association). A maximum of one ink ejection per line of the print image thus takes place via a specific nozzle. The nozzles 21, 22 may be distributed among multiple print heads 103. In the depicted example, the one or more print heads 103 are installed immobile or fixed in the printer 100, and the recording medium 120 is directed past the stationary nozzles 21, 22 with a defined transport velocity. Alternatively or additionally, the one or more print heads 103 may be moved across the recording medium 120 (for example along the transport direction 1).

Figure 2:
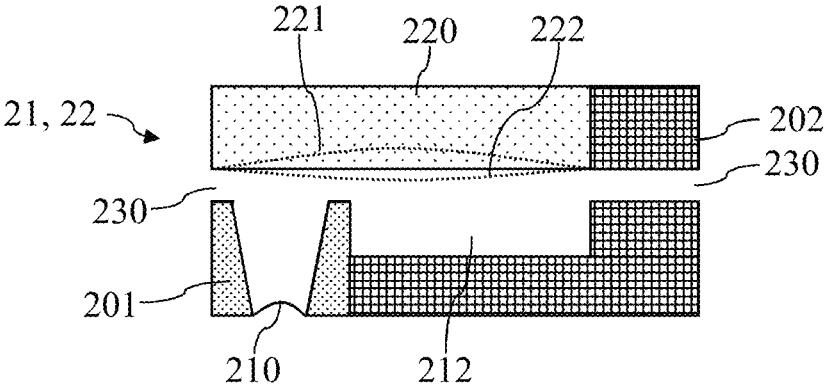
FIG. 2 illustrates a structure of a nozzle according to an exemplary embodiment of the present disclosure.

FIG. 2 illustrates a structure of a nozzle 21, 22 of a print head 103 according to an exemplary embodiment. In an exemplary embodiment, the nozzle 21, 22 includes walls 202 which, together with an actuator 220, form a receptacle or a pressure chamber 212 to accommodate ink (also referred to as an ink chamber 212). An ink droplet may be fired onto the recording medium 120 via a nozzle opening 201 of the nozzle 21, 22. The ink forms what is known as a meniscus 210 at the nozzle opening 201. In an exemplary embodiment, the nozzle 21, 22 further includes an actuator 220 (for example a piezoelectric element) that is configured to vary the volume of the pressure chamber 212 to take up ink, or to vary the mechanical pressure of the ink in the pressure chamber 212 of the nozzle 21, 22. In particular, the volume of the pressure chamber 212 may be reduced, and the pressure in the pressure chamber 212 increased, by the actuator 220 as a result of a deflection 222. An ink droplet is thus pushed from the nozzle 21, 22 via the nozzle opening 201. FIG. 2 shows a corresponding deflection 222 of the actuator 220 (dotted lines). Moreover, the volume of the pressure chamber 212 may be increased by the actuator 220 (see deflection 221) in order to draw new ink into the pressure chamber 212 via an ink supply channel 230.

Via a deflection 221, 222 of the actuator 220, the ink within the nozzle 21, 22 may thus be moved and the chamber 212 may be placed under mechanical pressure. A specific movement of the actuator 220 thereby produces a corresponding specific movement of the ink. The specific movement of the actuator 220 is typically produced by a corresponding specific waveform or a corresponding specific pulse of an activation signal of the actuator 220. In particular, via a fire pulse (also referred to as an ejection pulse) to activate the actuator 220, it may be produced that the nozzle 21, 22 ejects an ink droplet via the nozzle opening 201. Different ink droplets may be ejected by different activation signals at the actuator 220. In particular, ink droplets having different droplet size or having different ink quantities may thus be ejected. Furthermore, via a prefire pulse (also referred to as a pre-ejection pulse, or more generally as a non-ejection pulse) to activate the actuator 220 it may be produced that, although the nozzle 21, 22 produces a movement of the ink and an oscillation of the meniscus 210, no ink droplet is thereby ejected via the nozzle opening 201.

The different nozzles 21, 22 of a print head 103 are partially connected with one another, and with an ink reservoir, via one or more ink supply channels 230. Ink may be drawn into the pressure chamber 212 of a nozzle 21, 22 via the ink supply channels 230 (if the actuator 220 is positioned as the deflection 221, for example). The nozzles 21, 22 of a print head 103 may thereby mutually, indirectly affect one another via the one or more ink supply channels 230. This may lead to negative effects on the print quality of an inkjet printer 100.

FIG. 3*a* shows an arrangement of three nozzles 301, 302, 303 according to an exemplary embodiment that may be activated simultaneously. In the example depicted in FIG. 3*a*, the first nozzle 301 and the third nozzle 303 should thereby eject no ink at an activation point in time, whereas the second nozzle 302 should eject an ink droplet 311 at the activation point in time (which is illustrated by the relatively large deflection 222 of the actuator 220, represented in a dashed line). Within the scope of the ejection of an ink droplet 311, the second nozzle 302 sucks up ink via the one or more ink supply channels 230 (represented by the arrows in FIG. 3*a*).

Due to the one or more ink supply channels 230, the quantity of ink that is available to the second nozzle 302 for the ejection of an ink droplet 311 may depend on whether the first nozzle 301 and/or the third nozzle 303 print simultaneously or not. In particular, the quantity of ink changes if at least one of the adjacent nozzles 301, 303 does not print and/or exhibits no actuator deflection 222. As a result of this, an ink droplet 311 may be ejected with a varied quantity of ink, which leads to a modified dot size on the recording medium 120. The provided quantity of ink may differ from the instance in which both adjacent nozzles 301, 303 simultaneously print and/or exhibit an actuator deflection 222. In such an instance, an ink droplet 311 is typically ejected with a reduced quantity of ink, which leads to a reduced dot size on a recording medium 120. The intensity of the inking and/or the optical density of a column 31 of a print image 31 may thus depend on whether the nozzle 302 for this column 31 has active adjacent nozzles 301, 303.

FIG. 4*a* shows an example arrangement of multiple print heads 401, 402, 403 within a print bar 102. The print heads 401, 402, 403 can be arranged in one or more rows (a variant with two print head rows is depicted in FIG. 4*a*) next to one another, transversal to the transport direction 1. Directly adjacent print heads 401, 402 or 402, 403 may thereby be arranged "edge to edge" so that the nozzle 302 arranged directly at the edge 411 of the first print head 401, and the nozzle 303 arranged directly at the edge 412 of the second print head 302, print two directly adjacent columns 31, 32 of a print image. Also depicted in FIG. 4*a* is the nozzle 301 of the first print head 401, with which a column 31, 32 is printed that is likewise directly adjacent to the column 31, 32 printed by the nozzle 302. In particular, the column printed by the nozzle 302 is situated directly between the columns printed with the nozzles 301, 303.

Given the print head arrangement from FIG. 4*a*, a situation may thus occur in which the nozzles 301, 302, 303 for the printing of three columns 31, 32 of a print image in direct succession are printed at least in part by nozzles 302, 303 that are arranged directly at the edge 411, 412 of a print head 401, 402. These nozzles 302, 303 are referred to as edge region nozzles in the following. An edge region nozzle 302 is connected, via an ink channel 230, only with a single adjacent nozzle 301 within the same print head 401. As a result of this, an edge region nozzle 302 has a reduced influence on adjacent nozzles 301 in comparison to a nozzle 301 that is not arranged at the edge 411 of a print head 401. In a first approximation, an edge region nozzle 302 may be considered to be a nozzle of a print head 401 that has at least one directly adjacent nozzle that is never activated. As depicted in connection with FIG. 3*a*, this may lead to the situation that an edge region nozzle 302 ejects an ink droplet 311 with a modified size in comparison to a different nozzle 301 of a print head 401. This may in turn lead to the situation that print images at the edges 411, 412 of print heads 401, 402, 403 exhibit a modified inking and/or optical density.

FIG. 3*b* shows an example of a curve 320 of the optical density of a print image along the print width of a printer 100 having five print heads 103. In an exemplary embodiment, as shown in FIG. 4*a*, the optical density at the edges or borders 411, 412 of the print heads 401, 402, 403 exhibits a local increase, for example. Measurements have yielded that such local increases or variations of the optical density may extend across a print width of approximately 10-20 nozzles 21, 22, 302, meaning across 10-20 columns 31, 32 at the edge 411 of a print head 401.

FIG. 4*b* shows an exemplary embodiment of a print head arrangement in which the adjacent print heads 401, 402 or, respectively, 402, 403 respectively overlap in an overlap region 421 or 422. An overlap region 421, 422 may thereby have a width of approximately 20 to 30 columns 31, 32 of a print image. Due to the overlap, two respective nozzles—a nozzle 21 from a first print head 401 and a nozzle 22 from a second print head 402—are respectively available for the columns 31, 32 in an overlap region 421. In the present disclosure, the nozzles 301, 302 in an overlap region 421 of second print heads 401, 402 are referred to as overlap region nozzles. Otherwise, the nozzles 21, 22 outside of an overlap region 421, meaning in a non-overlap region 422, are referred to as non-overlap region nozzles.

In an exemplary embodiment, the double allocation in the overlap region 421 enables one or more overlap region nozzles 301, 302 to be removed from the printing operation for print data, starting from the edge 411 of a print head 401. In other words, one or more overlap region nozzles 301, 302 may not be used for the printing of dots in one or more corresponding columns 31, 322 of a print image. FIG. 4*b* shows a shaded region 431 at the edges 411, 412 of the print heads 401, 402, 403. In an exemplary embodiment, the nozzles of the print heads 401, 402, 403 in the shaded edge regions 431 may be referred to as edge region nozzles 301, 302 that are not used for the printing of print data. On the other hand, the nozzles 21, 22 in a complementary central region 422 may be referred to as central region nozzles.

In an exemplary embodiment, due to an overlapping of directly adjacent print heads 401, 402 in an overlap region 421, one or more edge region nozzles 301, 302 may thus respectively not be used for the printing of print data at the respective edges 411, 412 of the print heads 401, 402. This has the result that all remaining nozzles 21, 22 of the print heads 411, 412 that are used for the printing of print data (i.e. for the printing of the columns 31, 32 of a print image) respectively have two directly neighboring nozzles. The effects depicted in FIG. 3*b* may thus be prevented, or at least reduced, at the edges 411, 412 of print heads 401, 402. In an exemplary embodiment, if applicable, only 1%, 0.5%, 0.3%, 0.1% or fewer of the nozzles 21, 22 of a print head 401, 402 may thereby be reserved as edge region nozzles 301, 302. The print width of a printer 100 is thus not significantly reduced due to the overlapping of adjacent print heads 401, 402.

In an exemplary embodiment, as depicted in connection with FIG. 3*a*, a relative variation of the quantity of ejected ink of a nozzle 21 may already take place when the actuator 220 of the adjacent nozzle 22 is not activated. The one or more edge region nozzles 302 of a print head 401 are therefore preferably activated at least temporarily with a pre-ejection pulse so that all nozzles 21, 22 for printing of a print image are influenced, as uniformly as possible, by multiple neighboring nozzles. An especially homogeneous inking or optical density may thus be produced over the entire print width of a printer 100.

FIG. 4*c* shows activation data 450 according to an exemplary embodiment for activation of an edge region nozzle 301, 302, as well as for activation of a central region nozzle 21, 22. The central region nozzle 22, 23 is activated with ejection pulses 451 depending on the print data for a print image to be printed. An activation with a pre-ejection pulse 452 may take place as needed (for example in order to regenerate the ink within a central region nozzle 21, 22). Otherwise, an edge region nozzle 301, 302 is typically never activated with an ejection pulse 451. On the other hand, an activation with a pre-ejection pulse 452 takes place repeatedly (for example periodically) in order to influence one or more adjacent central region nozzles 21, 22.

In an exemplary embodiment, the controller 101 of a printer 100 is configured to generate the activation data 250, with the activation signals for the different nozzles 21, 22 of a print head 401, 402, based on the print data. In an exemplary embodiment, for each dot of a print image, the print data for a print image indicates whether an ink ejection should take place, and possibly what size an ejected ink droplet 311 should exhibit. The controller 101 may generate the activation data 250 for the nozzles 21, 22 from these print data for a print image. The activation data 250 image may thereby respectively indicate or comprise an activation signal for each nozzle 21, 22 and for each line of the print image. An activation signal for a nozzle 21, 22 may thereby correspond to a pulse with which a deflection 221, 222 of the actuator 220 of the nozzle 21, 22 is produced. Examples of pulses are an ejection pulse via which the ejection of an ink droplet 311 is produced, and a pre-ejection pulse or a non-ejection pulse via which no ink ejection is produced although a deflection 221, 222 of the actuator is produced. Furthermore, the activation data 250 for a nozzle 21, 22 and for a line may indicate that the actuator 220 of the nozzle 21, 22 should not be deflected. The respective activation signal for a nozzle 21, 22 and for a line may be encoded as a K-bit value (for example with K=2 or 3).

As depicted in FIG. 4*b*, a print head 401 may thus comprise a central region 432 with central region nozzles 21, 22. Central region nozzles 21, 22 are thereby typically, respectively used solely for printing of a column 31, 322 of a print image. Furthermore, the print head 401 may comprise at least one edge region 431 with at least one edge region nozzle 301, 302. An edge region nozzle 301, 302 is thereby typically used not for the printing of dots of a print image but rather only to influence an adjacent central region nozzle 21, 22.

Via an overlap with a different print head 402, an overlap region 421 is formed in which the two print heads 401, 402 overlap. The nozzles 21, 22 arranged in the overlap region 421 may be referred to as overlap region nozzles 301, 302. In an exemplary embodiment, the overlap region nozzles 301, 302 are operated in part as edge region nozzles 301, 302 and in part as central region nozzles 21, 22. In particular, one or more nozzles at the respective edge 411, 412 of the overlapping print heads 401, 402 may be operated as edge region nozzles 301, 302 (as depicted in FIG. 4*b*). In an exemplary embodiment, alternatively, the overlap region nozzles 301, 302 may be operated at least in part in a hybrid form between edge region nozzle 301, 302 and a central region nozzle 21, 22. In particular, an overlap region nozzle 21, 22 may be operated at least at some times as an edge region nozzle 301, 302 and at least at some times as a central region nozzle 21, 22. Advantageously, further optimization of the uniformity of the inking of a print image is produced at the transitions between print heads 401, 402.

In this document, an inkjet printer 100 is thus described that comprises at least one first print head 401 having a plurality of nozzles 21, 22. The plurality of nozzles 21, 22 may be configured to print a corresponding plurality of columns 31, 32 of a print image onto a recording medium 120. Each nozzle 21, 22 may thereby be associated with precisely one column 31, 32. Furthermore, each column 31, 32 may be associated with precisely one nozzle 21, 22. The inkjet printer 100 may be configured to move the recording medium 120 and the first print head 401 relative to one another along a transport direction 1. The columns 31, 32 of a print image may thereby travel in the transport direction 1. On the other hand, the lines of a print image may travel transversal to the transport direction 1. The nozzles 21, 22 of the first print head 401 may thereby be activated with a specific line clock in order to print the dots of different lines of a print image little by little onto the recording medium 120.

In an exemplary embodiment, the first print head 401 has a plurality of central region nozzles 21, 22 in a central region 432. Furthermore, the first print head 401 has at one edge 411 an edge region 431 with at least one first edge region nozzle 301. The plurality of nozzles 21, 22 of the first print head 401 may thus have a plurality of central region nozzles 21, 22 and at least one first edge region nozzle 301. The nozzles 21, 22, 301, 302 of the first print head 401 may thereby be connected at least partially with one another via an ink supply channel 230. A contiguous block of columns 31, 32 (arranged next to one another in relation to the transport direction 1) of a print image may be printed onto the recording medium 120 by the plurality of nozzles 21, 22. The first edge region nozzle 301 may thereby be configured to print a first column 31, 32 (possibly directly) at the edge of the block of columns 31, 32.

In an exemplary embodiment, the first print head 401 includes, at both edges 411, a respective edge region 431 with respectively one or more first edge region nozzles 301. Columns 31, 32 printed by the one or more first edge region nozzles 301 might then bound the columns 31, 32 printed by the central region nozzles 21, 22 in the block of columns 31, 32.

In an exemplary embodiment, the printer 100 also includes a controller 101 that is configured to activate the different central region nozzles 21, 22, based on print data for respective different columns 31, 32 of a print image, in order to print dots of a sequence of lines of the print image onto the recording medium 120. In other words, the central region nozzles 21, 22 may be used to print the dots of different columns 31, 32 of a print image. Each central region nozzle 21, 22 may thereby possibly print precisely one column 31, 32. The central region nozzles 21, 22 may then print the print image line by line onto the recording medium 120.

In an exemplary embodiment, on the other hand, the controller 101 is configured to not activate the first edge region nozzle 301 for the printing of dots of the print image during the printing of the print image. In particular, the first edge region nozzle 301 may be activated such that no (single) dot of the print image is printed by the first edge region nozzle 301. In other words, in the printing operation of the printer 100 the first edge region nozzle 301 may not be used for the printing of dots of a column 31, 32 of a print image. That is, in printing operation of the printer 100 the first edge region nozzle 301 may be associated with no (single) column 31, 32 of a print image to be printed. In particular, no single dot of a print image may be printed by the first edge region nozzle 301. Alternatively or additionally, no ink ejection may be produced by the first edge region nozzle 301 in the printing operation of the inkjet printer 100. Alternatively or additionally, the first edge region nozzle 301 may not contribute to the print width of the inkjet printer 100 that travels transversal to the transport direction 1 of the recording medium 120.

In an exemplary embodiment, nevertheless, during the printing of the print image the first edge region nozzle 301 is activated at least temporarily, meaning for at least some lines of the print image, with non-ejection pulses 451 without ink ejection. The non-ejection pulses 451 may thereby in particular be pre-ejection pulses or prefire pulses that may be used by the printer 100 to reduce the viscosity of the ink in a nozzle 21, 22.

In an exemplary embodiment, an inkjet printer 100 having at least one print head 401 in which at least one edge region nozzle 301 at the edge 411 of the print head 401 is not activated for the printing of a print image, but nevertheless is activated at least temporarily with non-ejection pulses 451 without ink ejection. It may thus be produced that a central region nozzle 21, 22 of the print head 401 that is used for the printing of the print image also has an adjacent, actively controlled nozzle 21, 22, 301 in proximity to the edge 411 of the print head 401. All nozzles 21, 22 of a print head 401 that are used for the printing of the print image thus have essentially identical printing conditions. As a result of this, intensity fluctuations of the dots of a print image may be reduced.

In an exemplary embodiment, the controller 101 is configured to activate the first edge region nozzle 301 in each line of a print image that is to be printed (e.g. with the line clock of the printer 100) with a non-ejection pulse 451. In other words, the first edge region nozzle 301 may be activated repeatedly with a non-ejection pulse 451 with the line clock. Advantageously, identical printing conditions for all nozzles 21, 22 of a print head 401 that are used for printing of the print image may thus be enabled in a reliable and resource-efficient manner.

In an exemplary embodiment, the controller 101 is configured to activate a first edge region nozzle 301 of the first print head 401 depending on the print data for at least one column 31, 32 of the print image. The print data of a print image may thus be taken into account in the operation of the one or more edge region nozzles 301 (which are not used for the print image). In particular, the non-ejection pulses 451 for a first edge region nozzle 301 may be generated depending on the print data of a print image. For example, the first edge region nozzle 301 may be activated precisely in the lines with a non-ejection pulse 451 in which a (directly adjacent) central region nozzle 21, 22 should print an (inked) dot. The uniformity of the inking of a print image may thus be increased in a particularly resource-efficient manner.

In an exemplary embodiment, a first edge region nozzle 301 is activated (in the same manner as a central region nozzle 21, 22) based on a line clock for printing of different lines of the print image. In particular, they may be generated with non-ejection pulses 451 to activate a first edge region nozzle 301 depending on a line clock. A first edge region nozzle 301 may thereby be activated with a non-ejection pulse in a line of the print image when (possibly only when) an ink ejection should be produced in the same line by at least one central region nozzle 21, 22. A non-ejection pulse may possibly thus only be produced if an influence on a (possibly directly adjacent) central region nozzle 21, 22 is actually required for the printing of a ("non-white") dot. The stress on a print head 401 may thus be reduced. Advantageously, an efficient reduction of intensity fluctuations of the dots of a print image is thus enabled.

In an exemplary embodiment, the first edge region nozzle 301 is configured to print a dot of a first column 31, 32 of a print image onto the recording medium 120 if the first edge region nozzle 301 is activated with an ejection pulse. In other words, if the first edge region nozzle 301 has been integrated into the printing of a print image, the dots of a first column 31, 32 might then be printed by the first edge region nozzle 301. The first column 31, 32 may thereby be arranged next to the columns 31, 32 (relative to the transport direction 1) that are printed by the plurality of central region nozzles 21, 22 onto the recording medium 120.

In an exemplary embodiment, the controller 101 is configured to activate the first edge region nozzle 301 with a non-ejection pulse if at least one central region nozzle 21, 22 is activated with an ejection pulse for printing of a column 31, 32 arranged directly adjacent to the first column 31, 32. Advantageously, intensity fluctuations of the dots of a print image may thus be reduced in an especially efficient and reliable manner.

In an exemplary embodiment, the first print head 401 includes multiple first edge region nozzles 301 (for example 5, 10, or more nozzles 301) in an edge region 431 at an edge 411 of the first print head 401. Intensity fluctuations of the dots of a print image may be further reduced via the use of multiple edge region nozzles 301. In an exemplary embodiment, the number of first edge region nozzles 301 may thereby be 5%, 2%, 1%, 0.5% or less of the number of central region nozzles 21, 22. In other words, only a relatively small proportion (for example 5%, 2%, 1%, 0.5% or less) of the nozzles 21, 22 of a print head 401 may be used as edge region nozzles 301. An efficient reduction of intensity fluctuations of the dots of a print image is thus enabled.

In an exemplary embodiment, the printer 100 includes a second print head 402 that has a central region 432 with a plurality of central region nozzles 21, 22 and, at least at one edge 412, an edge region 431 having at least one second edge region nozzle 302. The second print head 402 is typically designed to print dots with the same ink as the first print head 401, but is not limited thereto. In particular, the first and second print head 402 may be arranged within the same print bar 102 in order to print different blocks of columns 31, 32 of a print image. The different blocks of columns 31, 32 are thereby arranged next to one another in relation to the transport direction 1. The second print head 402 may be essentially structurally identical to the first print head 401.

As discussed above, the first edge region nozzle 301 may be configured to print dots of a first column 31, 32 of a print image. The second edge region nozzle 302 may be accordingly configured to print dots of a second column 31, 32 of a print image. The first and second column 31, 32 may thereby possibly be arranged directly next to one another.

The first print head 401 and the second print head 402 may be arranged such that a central region nozzle 21, 22 of the first print head 401 may print the dots of the second column 31, 32. Furthermore, the first print head 401 and the second print head 402 may be arranged such that a central region nozzle 21, 22 of the second print head 402 may print the dots of the first column 31, 32. Moreover, the first print head 401 typically has central region nozzles 21, 22 that may print dots of columns 31, 32 that cannot be printed by the second print head 402. Furthermore, the second print head 402 typically has central region nozzles 21, 22 that may print dots of columns 31, 32 that cannot be printed by the first print head 402.

Consequently, the first print head 401 and the second print head 402 may overlap in a limited overlap region 421, wherein the overlap region 421 comprises the first and second column 31, 32. On the other hand, the first print head 401 and the second print head 402 may respectively have a non-overlap region 422. A uniform intensity of dots may be efficiently produced at the transitions between two print heads 401, 402 via the use of partially overlapping print heads 401, 402.

In an exemplary embodiment, inkjet printer 100 is configured to print a print image onto a recording medium 120.

One or more aspects of the present disclosure are also respectively applicable to inkjet printer 100. In an exemplary embodiment, the inkjet printer 100 includes at least one print bar 102 having a first print head 401 and a second print head 402. The print bar 102 may be configured to print the dots of a line of a print image onto a recording medium 120, transversal to the transport direction 1, depending on a line clock. The nozzles 21, 22 of the print heads 401, 402 may thereby at least partially print the dots of a respective column 31, 32 of the print image onto the recording medium 120.

In an exemplary embodiment, the first print head 401 and the second print head 402 may overlap in an overlap region 421 such that dots of a common column 31, 32 of a print image may be printed with at least one first overlap region nozzle 301 of the first print head 401 and a second overlap region nozzle 302 of the second print head 402. On the other hand, the first print head 401 and the second print head 402 respectively comprise a plurality of non-overlap region nozzles 21, 22 in a respective non-overlap region 422, with which non-overlap region nozzles 21, 22 respective different columns 31, 32 of a print image may be printed. The first print head 401 and the second print head 402 may thus be arranged overlapping such that at least one column 31, 32 may be printed both by a first (overlap region) nozzle 301 of the first print head 401 and by a second (overlap region) nozzle 302 of the second print head 402. On the other hand, both the first print head 401 and the second print head 402 respectively have a plurality of non-overlap region nozzles 21, 22 via which a respective column 31, 32 may be printed that may not be printed by any other nozzle 21, 22 of the print bar 102. As has already been presented above, the partial overlapping of adjacent print heads 401, 402 efficiently enables a uniform intensity of dots of a print image to be produced.

In an exemplary embodiment, the printer 100 includes controller 101 that is configured to activate the different non-overlap region nozzles 21, 22 based on print data for respective different columns 31, 32 of a print image in order to print dots of the print image onto the recording medium 120. Typically, precisely one column 31, 32 of the print image may thereby be printed by each non-overlap region nozzle 21, 22.

In an exemplary embodiment, the controller 101 is configured to activate a respective actuator 220 of the first overlap region nozzle 301 and/or of the second overlap region nozzle 302 such that dots of the print image are printed onto the recording medium 120 by the first overlap region nozzle 301 and/or by the second overlap region nozzle 302. The first overlap region nozzle 301 and/or the second overlap region nozzle 302 may thus be used to print the dots of the common column 31, 32 (in the overlap region 421).

In an exemplary embodiment, via the controller 101, it may be brought about that both the actuator 220 of the first overlap region nozzle 301 and the actuator 220 of the second overlap region nozzle 302 are at least temporarily activated during the printing of the print image. In other words, via the controller 101 it may be ensured that both the first overlap region nozzle 301 and the second overlap region nozzle 302 are active during the printing of a print image, and thus produce an influence on at least one non-overlap region nozzle 21, 22 of the first print head 401 or of the second print head 402. A uniform inking of the dot of a print image may thus also be enabled at the transitions of print heads 401, 402 of a print bar 102.

In an exemplary embodiment, the controller 101 is configured to activate the actuator 220 of the first overlap region nozzle 301 based on the print data for a sequence of lines of the common columns 31, 32 in order to print the dots of the sequence of lines of the print image onto the recording medium 120. Furthermore, in an exemplary embodiment, the controller 101 is configured to activate the actuator 220 of the second overlap region nozzle 302 at least temporarily (i.e. for at least some of the lines of the sequence of lines) with non-ejection pulses 451, without ink ejection (in order to produce a deflection 221 of the actuator 220 but no ink ejection). In particular, the actuator 220 of the second overlap region nozzle 302 may be activated with a non-ejection pulse 451 for each line of the sequence of lines. It may thus be reliably achieved that both overlap region nozzles 301, 302 are active during the printing of a print image in order to produce a uniform inking of the dot of the print image.

In an exemplary embodiment, the controller 101 is configured to at least temporarily activate the actuator 220 of the first overlap region nozzle 301 and at least temporarily activate the actuator 220 of the second overlap region nozzle 302, depending on the print data for the common column 31, 32, in order to print the dots of different lines of the print image onto the recording medium 120. Both overlap region nozzles 301, 302 may thus be used in part for the printing of the dots of the common column 31, 32. The overlap region nozzle 301, which is not used for the printing of the dots of the common column 31, 32 at a defined point in time, may then be activated with a non-ejection pulse at least for a portion of the lines. The width of an overlap region nozzle 421 (meaning the number of common columns 31, 32 in an overlap region 421) may be reduced via the use of both overlap region nozzles 301, 302 for the printing of the common column 31, 32. A uniform inking of the dots of a print image is thus particularly efficiently enabled.

In an exemplary embodiment, the overlap region 421 includes at least two first overlap region nozzles 301 of the first print head 401 and at least two second overlap region nozzles 302 of the second print head 402. The first overlap region nozzles 301 and the second overlap region nozzles 302 may thereby be designed to respectively print a common column 31, 32 of a print image in pairs. For example, 5%, 2%, 1%, 0.5% or less of the nozzles 21, 22 of a print head 401, 402 may be arranged in an overlap region 421.

In an exemplary embodiment, the controller 101 is configured to activate the additional first and second overlap region nozzle 301, 302, at a distance from a respective edge 411, 422 of the first or second print head 401, 402, based on print data for the respective columns 31, 32 of the print image in order to print dots of the print image onto the recording medium 120. The overlap region nozzles 301, 302 which are further distant from the respective edge 411, 412 may thus be used (possibly alone) for printing of the respective column 21, 22 (meaning that they are operated as central region nozzles 301, 302).

In an exemplary embodiment, on the other hand, the first and second overlap region nozzle 301, 302 arranged closer to the respective edge 411, 412 may be activated at least temporarily as with non-ejection pulses 451 without ink ejection. The first or second overlap region nozzle 301, 302 arranged closer to the respective edge 411, 412 may thus be operated as a first edge region nozzle 301 or as a second edge region nozzle 302. The respective nozzles 301, 302 arranged at the edge 411, 412 of a print head 401, 402 may thus remain unconsidered in the printing of a print image. These nozzles 301, 302 may nevertheless be activated at least temporarily with non-ejection pulses 451. A particularly uniform inking of the dots of a print image may thus be enabled.

FIG. 5 shows a workflow diagram of a method 500 for printing of a print image onto a recording medium 120 according to an exemplary embodiment. The method 500 may be executed by the controller 101 of a printer 100. In an exemplary embodiment, the method 500 includes the activation 501 of different central region nozzles 21, 22 of a first print head 401. The first print head 401 thereby includes a central region 432 with multiple central region nozzles 21, 22, and an edge region 431 with at least one first edge region nozzle 301 at least at one edge 411 of the print head 401. The different central region nozzles 21, 22 are activated depending on print data for respective different columns 31, 32 of the print image in order to print dots of the print image onto the recording medium 120.

In an exemplary embodiment, the method 500 further includes the activation 502 of the first edge region nozzle 301 during the printing of the print image, not for the printing of dots of the print image but at least temporarily with non-ejection pulses 451 without ink ejection. A uniform inking of dots of the print image may thus be produced.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle
31, 32 column (of the print image)
100 printer
101 controller
102 print bar
103 print head
120 recording medium
140 print group
170 fixer
201 nozzle opening
202 wall
210 meniscus
212 chamber
220 actuator (piezoelectric element)
221, 222 deflection of the actuator
230 ink supply channel
301-303 nozzle
311 ink droplet
320 curve of the optical density along the line of a print image
401-403 print head
411, 412 edge of a print head
421 overlap region

422 non-overlap region
431 edge region
432 central region
450 activation data
451 non-ejection pulse (pre-ejection pulse)
452 ejection pulse
500 method for printing a print image
501-502 method steps

What is claimed is:

1. An inkjet printer, comprising:

a print head including a central region having a plurality of central region nozzles and, at least at one edge, and an edge region having at least one first edge region nozzle, wherein no ink ejection is produced by the at least one first edge region nozzle in a printing operation of the inkjet printer, and wherein the at least one first edge region nozzle is associated with no column of a print image in the printing operation of the inkjet printer; and a controller that, in the printing operation, is configured to simultaneously:

(a) activate different central region nozzles of the plurality of central region nozzles based on print data for respective different columns of the print image to print dots of the print image, line by line, onto a recording medium; and (b) activate the at least one first edge region nozzle, during the activation of the different central region nozzles for printing of the print image, with a non-ejection pulse without ink ejection such that no single dot of the print image is printed by the at least one first edge region nozzle.

2. The inkjet printer according to claim 1, wherein the at least one first edge region nozzle does not contribute to a print width of the inkjet printer that travels transversal to a transport direction of the recording medium.

3. The inkjet printer according to claim 1, wherein the controller is configured to:

activate the at least one first edge region nozzle with non-ejection pulses for at least one column of the print image based on the print data;

activate the at least one first edge region nozzle with non-ejection pulses for printing of different lines of the print image based on a line clock; or activate the at least one first edge region nozzle with a non-ejection pulse in a line of the print image if an ink ejection is to be produced by at least one central region nozzle in the same line.

4. The inkjet printer according to claim 1, wherein the controller is configured to activate the at least one first edge region nozzle with a non-ejection pulse in each line of the print image.

5. The inkjet printer according to claim 1, wherein:

the at least one first edge region nozzle is configured to print a dot of a first column of the print image onto the recording medium if the at least one first edge region nozzle is activated with an ejection pulse;

the first column is arranged adjacent to a column that is printed onto the recording medium by the plurality of central region nozzles; and the controller is configured to activate the at least one first edge region nozzle with a non-ejection pulse if at least one central region nozzle of the plurality of central region nozzles is activated with an ejection pulse for the printing of a column arranged directly adjacent to the first column.

6. The inkjet printer according to claim 3, wherein:

the at least one first edge region nozzle is configured to print a dot of a first column of the print image onto the recording medium if the at least one first edge region nozzle is activated with an ejection pulse;

the first column is arranged adjacent to a column that is printed onto the recording medium by the plurality of central region nozzles; and the controller is configured to activate the at least one first edge region nozzle with a non-ejection pulse if at least one central region nozzle of the plurality of central region nozzles is activated with an ejection pulse for the printing of a column arranged directly adjacent to the first column.

7. The inkjet printer according to claim 1, wherein:

the printer further comprises a second print head that includes a central region having a plurality of central region nozzles and, at an edge, an edge region having at least one second edge region nozzle;

the at least one first edge region nozzle is configured to print dots of a first column of a print image;

the second edge region nozzle is configured to print dots of a second column of the print image; and the first print head and the second print head are arranged such that:

a central region nozzle of the first print head is configured to print the dots of the second column;

a central region nozzle of the second print head is configured to print the dots of the first column;

the first print head has central region nozzles of the plurality of central region nozzles that are configured to print dots of columns that cannot be printed by the second print head; and the second print head has central region nozzles of plurality of central region nozzles that may print dots of columns that cannot be printed by the first print head.

8. The inkjet printer according to claim 3, wherein:

the printer further comprises a second print head that includes a central region having a plurality of central region nozzles and, at an edge, an edge region having at least one second edge region nozzle;

the at least one first edge region nozzle is configured to print dots of a first column of a print image;

the second edge region nozzle is configured to print dots of a second column of the print image; and the first print head and the second print head are arranged such that:

a central region nozzle of the first print head is configured to print the dots of the second column;

a central region nozzle of the second print head is configured to print the dots of the first column;

the first print head has central region nozzles of the plurality of central region nozzles that are configured to print dots of columns that cannot be printed by the second print head; and the second print head has central region nozzles of plurality of central region nozzles that may print dots of columns that cannot be printed by the first print head.

9. The inkjet printer according to claim 5, wherein:

the printer further comprises a second print head that includes a central region having a plurality of central region nozzles and, at an edge, an edge region having at least one second edge region nozzle;

the at least one first edge region nozzle is configured to print dots of a first column of a print image;

the second edge region nozzle is configured to print dots of a second column of the print image; and the first print head and the second print head are arranged such that:

a central region nozzle of the first print head is configured to print the dots of the second column;

a central region nozzle of the second print head is configured to print the dots of the first column;

the first print head has central region nozzles of the plurality of central region nozzles that are configured to print dots of columns that cannot be printed by the second print head; and the second print head has central region nozzles of plurality of central region nozzles that may print dots of columns that cannot be printed by the first print head.

10. An inkjet printer, comprising:

at least one print bar having a first print head and a second print head, the first print head and the second print head overlapping in an overlap region such that dots of a common column of a print image is printable with at least one first overlap region nozzle of the first print head and at least one second overlap region nozzle of the second print head, wherein the first print head and the second print head respectively include a plurality of non-overlap region nozzles in a respective non-overlap region, with which different columns of a print image are printable by respective non-overlap region nozzles, the overlap region including at least two first overlap region nozzles of the first print head and at least two second overlap region nozzles of the second print head; and a controller that is configured to:

activate the first and second overlap region nozzles, which are at a distance from a respective edge of the first or second print head, based on print data for the respective columns of the print image to be printed, to print dots of the print image onto the recording medium; and at least temporarily activate, simultaneously during activation of the first and second overlap region nozzles that are at the distance from the respective edge of the first or second print head for printing of the print image, the first and second overlap region nozzles arranged closer to the respective edge than the respective non-overlap region nozzles with non-ejection pulses, without ink ejection, such that no single dot of the print image is printed by the first and second overlap region nozzles arranged closer to the respective edge.

11. The inkjet printer according to claim 10, wherein the controller is configured to activate the first and the second overlap region nozzles arranged closer to the respective edge with a non-ejection pulse, without ink ejection, in each line of a sequence of lines of the print image.

* * * * *